US008555831B2

(12) United States Patent
Paa et al.

(10) Patent No.: US 8,555,831 B2
(45) Date of Patent: Oct. 15, 2013

(54) METHOD FOR OPERATING A TWO-STROKE ENGINE

(75) Inventors: Andreas Paa, Winnenden (DE); Michael Harrer, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 273 days.

(21) Appl. No.: 12/801,135

(22) Filed: May 25, 2010

(65) Prior Publication Data

US 2010/0307469 A1 Dec. 9, 2010

(30) Foreign Application Priority Data

Jun. 5, 2009 (DE) ..... 10 2009 023 964

(51) Int. Cl.
*F02B 25/00* (2006.01)

(52) U.S. Cl.
USPC ..... 123/73 R; 123/73 A; 123/406.17; 123/406.26; 123/478; 123/676; 701/103

(58) Field of Classification Search
USPC ..... 123/257, 73 A, 260, 406.18, 406.26, 123/73 R, 478, 494, 406.55, 676, 406.53, 123/491, 541, 687, 679, 689, 406.17; 701/103; 251/305; 73/114.01, 114.02, 73/114.16, 114.17, 114.18; 60/274
See application file for complete search history.

(56) References Cited

U.S. PATENT DOCUMENTS

| | | | | |
|---|---|---|---|---|
| 4,446,833 | A * | 5/1984 | Matsushita et al. | 123/435 |
| 4,461,260 | A * | 7/1984 | Nonaka et al. | 123/478 |
| 5,051,909 | A * | 9/1991 | Gomez et al. | 701/103 |
| 5,404,843 | A * | 4/1995 | Kato | 123/73 B |
| 5,586,524 | A * | 12/1996 | Nonaka et al. | 123/73 A |
| 5,657,625 | A * | 8/1997 | Koga et al. | 60/274 |
| 6,367,772 | B1 * | 4/2002 | Glogovcsan, Jr. | 251/305 |
| 6,393,903 | B1 * | 5/2002 | Reed et al. | 73/114.01 |
| 7,185,632 | B2 * | 3/2007 | Knaus | 123/406.25 |
| 7,325,528 | B2 * | 2/2008 | Schieber et al. | 123/257 |
| 7,536,983 | B2 * | 5/2009 | Layher et al. | 123/73 B |

FOREIGN PATENT DOCUMENTS

EP 417984 A1 * 3/1991

* cited by examiner

*Primary Examiner* — Noah Kamen
*Assistant Examiner* — Grant Moubry
(74) *Attorney, Agent, or Firm* — Walter Ottesen P.A.

(57) ABSTRACT

A two-stroke engine (1) has a cylinder (2) defining a combustion chamber (3) delimited by a piston (5). The piston (5) drives a crankshaft (7) which is rotatably journalled in a crankcase (4). The crankcase (4) is connected to the combustion chamber (3) via a transfer channel (17) at at least one position of the piston. The two-stroke engine has an inlet (11) into the crankcase (4) and an outlet (19) from the combustion chamber. There is an arrangement to supply fuel, a control, and a device to determine the crankcase pressure ($p_{KGH}$). A method to operate the two-stroke engine (1) includes determining the crankcase pressure ($p_{KGH}$) during every engine cycle. The fluctuation in the crankcase pressure ($p_{KGH}$) is determined and the fluctuation is compared to a limit value ($\Delta p_{limit}$) to determine whether a combustion occurs during every engine cycle. In this way, a determination can be reliably made as to whether the two-stroke engine is running in a four-stroke mode.

10 Claims, 2 Drawing Sheets

METHOD FOR OPERATING A TWO-STROKE ENGINE

CROSS REFERENCE TO RELATED APPLICATION

This application claims priority of German patent application no. 10 2009 023 964.2, filed Jun. 5, 2009, the entire content of which is incorporated herein by reference.

FIELD OF THE INVENTION

The invention relates to a method for operating a two-stroke internal combustion engine wherein the crankcase pressure is measured in each engine cycle.

BACKGROUND OF THE INVENTION

It is known that two-stroke engines can slip into a four-stroke mode. In this operating mode, a combustion occurs only every second rotation of the crankshaft. In this operating mode, increased exhaust-gas values can result for the two-stroke engine. Furthermore, faulty settings can occur in setting the amount of fuel supplied during the four-stroke operation. It is therefore desirable to recognize if a combustion is occurring in every engine cycle of the internal combustion engine.

From U.S. Pat. No. 7,325,528 it is known that the four-stroke operation has an effect on the pressure level in the crankcase. From the pressure level in the crankcase alone, however, four-stroke operation can not be reliably determined, since the pressure level is also influenced by other factors such as the rotational speed or other engine parameters.

SUMMARY OF THE INVENTION

It is an object of the invention to provide a method for operating a two-stroke engine wherein it can reliably be determined without elaborate sensors if a combustion occurs in every engine cycle.

The method of the invention is for operating a two-stroke engine, the two-stroke engine having a cylinder defining a combustion chamber; the combustion chamber being delimited by a piston; the piston being configured to drive a crankshaft rotatably mounted in a crankcase; the crankcase being connected to the combustion chamber at at least one position of the piston via a transfer channel; the two stroke engine having an inlet into the crankcase and a outlet out of the combustion chamber; the two-stroke engine further having an arrangement configured to supply fuel, a control and a device determining crankcase pressure. The method includes the steps of: determining the crankcase pressure ($p_{KGH}$) each engine cycle; determining a fluctuation in the crankcase pressure ($p_{KGH}$); and, comparing the fluctuation to a limit value ($\Delta p_{limit}$) to determine whether a combustion occurs during each engine cycle.

It has been shown, that the fluctuations of pressure in the crankcase enable a reliable determination of whether a combustion takes place in every engine cycle or whether engine cycles occur without a combustion taking place. To detect the fluctuations of the crankcase pressure only means to determine pressure are needed, such as a simple pressure sensor in the crankcase. The sensor is often already present so that no additional sensors are required.

It has been shown that the crankcase pressure remains comparably constant at a given time point in the engine cycle if a combustion is occurring in each engine cycle. If, on the other hand, no combustions take place during some engine cycles, then the pressure level in the crankcase fluctuates very greatly. Via the pressure fluctuations it can not only be determined whether a combustion is occurring every rotation of the crankshaft, but also whether the engine cycle regularly has no combustion every other rotation, therefore being operated in a four-stroke mode. It can also be determined if a different number of engine cycles with combustion and engine cycles without combustion are occurring, for example, if a combustion occurs every third, fourth or fifth rotation of the crankshaft.

The engine can be controlled based on recognized patterns of engine cycles with combustion and engine cycles without combustion.

Advantageously, the fluctuation of the crankcase pressure is determined as a difference between the crankcase pressure and a mean value of the crankcase pressure. The mean value of the crankcase pressure can, for example, be a mean value of multiple successive measurements of the crankcase pressure.

Advantageously, the crankcase pressure is measured at the same crankshaft angle during each cycle. Here, the crankcase pressure is especially measured at a crankshaft angle at which the crankcase is closed. In particular, the crankcase pressure is measured during the upward stroke of the piston after the closing of the transfer channel and prior to opening the inlet. It has become evident, that pressure fluctuations in the crankcase result from pressure fluctuations in the combustion chamber which are transferred to the crankcase via the transfer channel. If the pressure in the crankcase is measured after the closing of the transfer channel and prior to the opening of the inlet, then the pressure fluctuations are most pronounced. This is so because the combustion chamber pressure has been transferred to the crankcase via the transfer channel and the inlet is still closed and therefore no fresh combustion air has been drawn in.

Advantageously, whether the engine is running in four-stroke mode is determined from the fluctuations in crankcase pressure. When four-stroke operation is recognized, the amount of fuel supplied is reduced until four-stroke operation no longer occurs. To preclude that the pressure fluctuations in the crankcase are not caused by non-occurring combustions, but are caused by other influences, for example, a change in rpm or the like, it is provided that, in addition to the crankcase pressure, the rpm of the engine and/or the volumetric efficiency of the engine are monitored and compared to a limit value. The volumetric efficiency of the engine can thereby also be determined by simple means from the crankcase pressure signal at two predetermined crankshaft angles ahead of the opening of the transfer channels and after the opening of the transfer channels.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
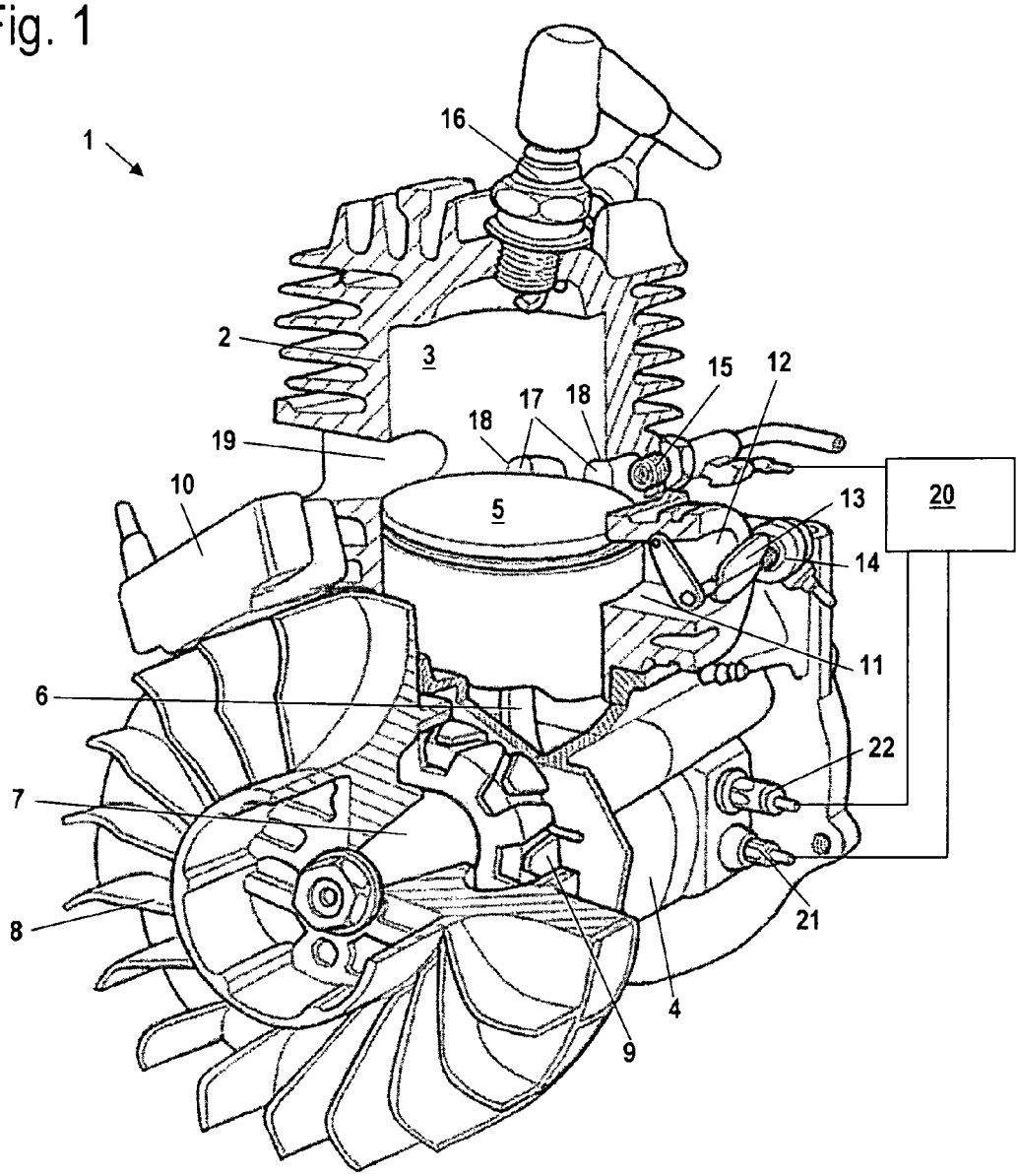
FIG. 1 is a perspective view, partially in section, of a two-stroke engine.

FIG. 1 shows a two-stroke engine 1, which is configured as a single-cylinder engine and which can be the drive motor for a handheld tool such as a chain saw, cutoff machine, brushcutter, lawn mower or the like. The two-stroke engine 1 has a cylinder 2 in which a combustion chamber 3 is formed. The combustion chamber 3 is delimited by a piston 5 which moves back and forth in the cylinder 2 and is mounted therein. The piston 5 drives a crankshaft 7 rotatably mounted in a crankcase 4 via a connecting rod 6. In the area of bottom dead center of the piston 5 (FIG. 1), the interior space of the crankcase 4 is connected to the combustion chamber 3 via a total of four transfer channels 17 of which two are shown in FIG. 1. The transfer channels 17 open into the combustion chamber 3 via transfer windows 18. An outlet 19 for exhaust gases leads out of the combustion chamber 3. An inlet 11 slot-controlled by the piston 5 opens into the crankcase 4. At the inlet 11, an intake channel 12 opens via which combustion air is supplied to the two-stroke engine 1. An air/fuel mixture can also be supplied to the crankcase 4 via the intake channel 12. A throttle flap 13 is pivotally mounted in the intake channel 12 which serves to control the amount of air supplied. A throttle flap sensor 14, by which the position of the throttle flap can be determined, is arranged on the throttle flap 13. The throttle flap sensor. 14 can, however, also be omitted.

A fuel valve 15, which in the embodiment opens into an transfer channel 17, is provided to supply fuel. The fuel valve 15 can, however, also open into the crankcase 4 or the intake channel 12. A temperature sensor 21 and a pressure sensor 22 are arranged on the crankcase 4. The temperature sensor 21, the pressure sensor 22, and the fuel valve 15 are connected to a control 20.

A generator 9, which provides an rpm signal, is arranged on the crankshaft 7. The generator 9 can also provide energy to operate further electric units and a spark plug 16. The spark plug 16 protrudes into the combustion chamber 3 and serves to ignite the mixture in the combustion chamber 3. Furthermore, a fan wheel 8 is mounted on the crankshaft 7 so as to rotate therewith. An ignition module 10 is provided at the outer periphery of the fan wheel 8, into which the energy to operate the spark plug 16 is induced, if the generator is not used for this purpose. Furthermore, the ignition module can also supply an rpm signal. The ignition module 10 and the generator are connected to the control 20.

During operation, combustion air is supplied to the crankcase 4 of the two-stroke engine. The combustion air is compressed during the downward stroke of the piston 5 in the crankcase 4 and, in the region of bottom dead center of the piston, flows into the combustion chamber 3 via the transfer channels 17. During transfer or during the compression, the fuel valve 15 can supply the combustion air with fuel. In the combustion chamber 3, the air/fuel mixture is compressed during the upward stroke of the piston 5 and is ignited by the spark plug 16 in the region of the top dead center of the piston 5. As a result of the combustion of the mixture in the combustion chamber 3, the piston 5 is accelerated in the direction of the crankcase 4. As soon as the outlet 19 is opened by the piston 5, the exhaust gases escape from the combustion chamber 3. It can also be provided that the two-stroke engine 1 additionally has an air channel via which largely fuel-free combustion air is prestored in the transfer channels 17 in order to separate the exhaust gases from the incoming fresh mixture.

The amount of fuel to be supplied to the two-stroke engine 1 is controlled by the control 20. For this purpose, the control 20 evaluates the revolutions per minute (n) of the two-stroke engine 1. In order to better determine the amount of fuel (x) to be supplied, it is advantageous when the control 20 detects when a combustion does not occur in the combustion chamber in every engine cycle.

Figure 2:
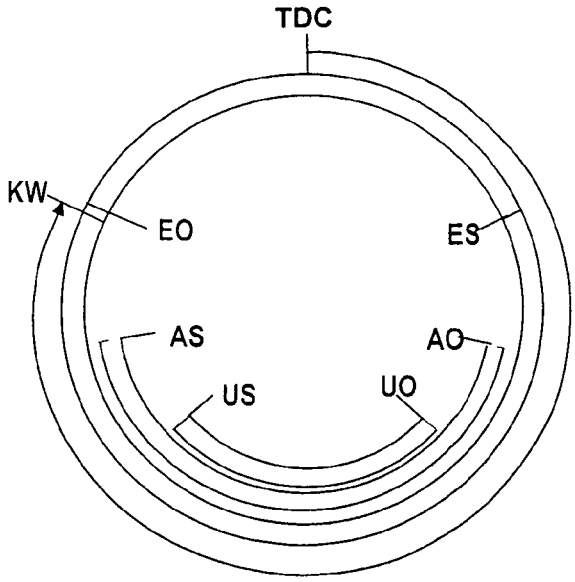
FIG. 2 is a diagram of the control times of the two-stroke engine of FIG. 1.

In FIG. 2, the control times of the two-stroke engine 1 are shown. During the downward stroke of the piston 5 from top dead center TDC, the inlet 11 opens first at time point ES. Subsequently, the outlet 19 opens at time point AO. During the further downward stroke of the piston 5, the transfer channels 17 open at time point UO. During the upward stroke of the piston 5, the sequence of windows opening and closing is reversed. First, the transfer channels 17 close at time point US. Subsequently, the outlet 19 closes at time AS. Then the inlet 11 opens at time point EO. To determine whether there is a combustion in the combustion chamber 3 during every revolution of the crankshaft 7, the crankcase pressure $p_{KGH}$ is measured at a crankshaft angle $KW_1$ at which the crankcase 4 is completely closed. This is the case when the transfer channels 17 are closed and the inlet 11 is not yet open. Advantageously, the pressure $p_{KGH}$ is measured by the pressure sensor 22 at a crankshaft angle $KW_1$ shortly before time point EO when the inlet 11 opens.

Figure 3:
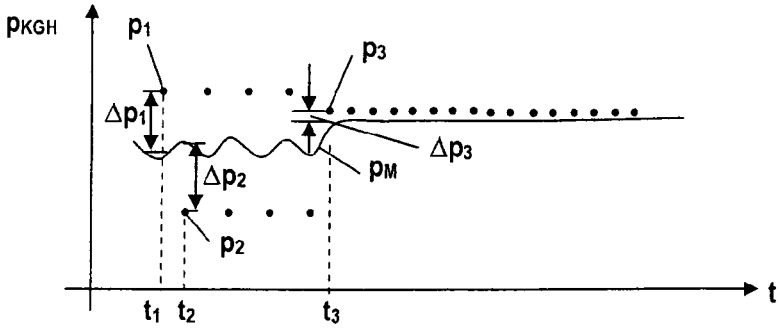
FIG. 3 is a diagram that shows the crankcase pressure as a function of time.

FIG. 3 shows the individually measured pressure values for the crankcase pressure $p_{KGH}$ at the crankshaft angle $KW_1$ as a function of time. As FIG. 3 shows, the pressure values initially fluctuate very greatly. From the time point ($t_3$) the pressure values are at a near constant level. Up until time point ($t_3$), the two-stroke engine 1 is operated in four-stroke mode, that is, a combustion occurs in the combustion chamber 3 only every second revolution of the crankshaft. The pressure value ($p_1$) represents the crankcase pressure $p_{KGH}$ at time point ($t_1$), after a combustion has taken place in the combustion chamber 3. The pressure value ($p_2$) represents the pressure $p_{KGH}$ in the crankcase 4 at time point ($t_2$) after an engine cycle during which no combustion occurred in combustion chamber 3.

Figure 4:
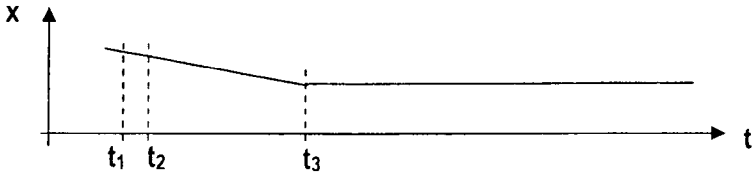
FIG. 4 is a diagram that shows the amount of fuel supplied as a function of time; and, FIG. 5 is a flowchart of the method according to the invention.

FIG. 3 further shows a mean value $p_M$ for the crankcase pressure $p_{KGH}$. To establish in a simple manner whether the two-stroke engine 1 is being operated in four-stroke mode, the pressure difference $\Delta p_1$ between the pressure value ($p_1$) and the mean value ($p_M$) is determined. Likewise, the pressure difference $\Delta p_2$ for the pressure value ($p_2$) to the mean value ($p_M$) is determined. The mean value ($p_M$) is the mean value over a plurality of pressure values ($p_1$, $p_2$), for example, over pressure values from eight successive engine cycles determined at crankshaft angle $KW_1$. As FIG. 3 shows, the pressure differences ($\Delta p_1$, $\Delta p_2$) are comparatively large. The pressure differences ($\Delta p_1$, $\Delta p_2$) are compared to one or multiple limit values $\Delta p_{limit}$. The control recognizes therefrom that the two-stroke engine 1 is running in four-stroke mode. The pressure value $p_1$ is the pressure at time point $t_1$ and the pressure value $p_2$ is the pressure value at time point $t_2$. At each of these time points, the quantity of fuel (x) supplied is decreased as shown in FIG. 4. Since there are still large pressure fluctuations of the crankcase pressure $p_{KGH}$ subsequently, as shown in FIG. 3, the amount of fuel (x) is further decreased. At time point $t_3$, there is a pressure $p_3$ at crankshaft angle $KW_1$ in the crankcase 4, which has a very small pressure difference $\Delta p_3$ relative to the mean value $p_M$. The subsequent pressure values are at about the same level, therefore the crankcase pressure $p_{KGH}$ at crankshaft angle $KW_1$ is approximately constant from time point $t_3$ on. Starting at time point $t_3$, there is a combustion in the combustion chamber 3 during every revolution of the crankshaft 7. For this reason, the supplied amount of fuel (x) is no longer decreased. The supplied amount of fuel (x) can from time point $t_3$ onward be determined in the usual manner by the control 20.

Figure 5:
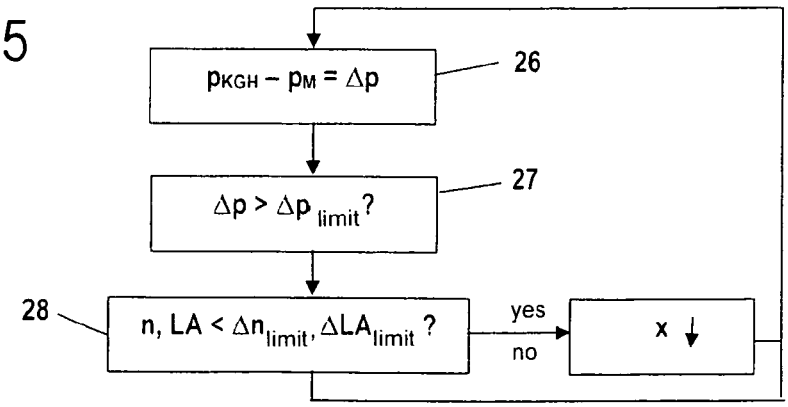

FIG. 5 shows the course of the method schematically. In method step 26, the crankcase pressure $p_{KGH}$ is detected and the pressure difference $\Delta p$ between the current crankcase pressure $p_{KGH}$ and the mean value $p_M$ is determined. In method step 27, the pressure difference $\Delta p$ is compared to a limit value $\Delta p_{limit}$. In method step 28, a determination is made as to whether the change in rpm (n) is less than a limit value $\Delta n_{limit}$ for the change of the rpm (n) and whether the change of the volumetric efficiency LA is less than a limit value $\Delta LA_{limit}$ for the change of the volumetric efficiency LA. If this is the case, that is, the rpm (n) and the volumetric efficiency LA are approximately constant, then the supplied amount of fuel (x) is reduced. Otherwise the supplied amount of fuel (x) remains unaffected and the method is repeated the following engine cycle.

In the embodiment, the detection of four-stroke operation is described. With the method, however, other combustion patterns can be detected. The method can also be used to check whether a desired combustion pattern, such as a combustion every 3, 4, 5, or 6 engine cycles, is actually present. Advantageously, the method is performed with the two-stroke engine 1 at full load. The method can, however, also be advantageously used in other operating conditions of the two-stroke engine 1.

It is understood that the foregoing description is that of the preferred embodiments of the invention and that various changes and modifications may be made thereto without departing from the spirit and scope of the invention as defined in the appended claims.

What is claimed is:

1. A method for operating a two-stroke engine, said two-stroke engine configured as a single cylinder engine having a cylinder defining a combustion chamber; said combustion chamber being delimited by a piston; said piston being configured to drive a crankshaft rotatably mounted in a crankcase; said crankcase being connected to said combustion chamber at least at one position of said piston via a transfer channel; said two stroke engine having an inlet into said crankcase and an outlet out of said combustion chamber; said two-stroke engine further having an arrangement configured to supply fuel, a control and a device determining crankcase pressure ($p_{KGH}$) during engine cycles of said engine; said method comprising the steps of:

determining said crankcase pressure ($p_{KGH}$) for each engine cycle;

determining a mean value ($p_M$) of said crankcase pressure ($p_{KGH}$) from a plurality of values for said crankcase pressure ($p_{KGH}$) measured during previous engine cycles;

in each one of said engine cycles, determining a fluctuation in said crankcase pressure ($p_{KGH}$) determined in said one engine cycle as a difference between said determined crankcase pressure ($p_{KGH}$) and said mean value ($p_M$) of said crankcase pressure ($p_{KGH}$); and, determining whether a combustion occurred during each engine cycle by comparing said difference to a limit value ($\Delta p_{limit}$).

2. The method of claim 1, wherein said crankcase pressure ($p_{KGH}$) is measured every engine cycle at the same crankshaft angle.

3. The method of claim 1, wherein said crankcase pressure ($p_{KGH}$) is measured at a crankshaft angle ($KW_1$) whereat said crankcase is closed.

4. The method of claim 3, wherein said crankcase pressure ($p_{KGH}$) is measured during an upward stroke of said piston, after closing said transfer channel and prior to opening said inlet.

5. The method of claim 1, wherein said crankcase pressure ($p_{KGH}$) is measured shortly before the inlet is opened.

6. The method of claim 1, comprising the further step of determining whether said two-stroke engine is running in four-stroke operation.

7. The method of claim 6, comprising the further step of decreasing the amount of said fuel supplied if four-stroke operation is detected until four-stroke operation has ceased.

8. The method of claim 7, comprising the further steps of monitoring revolutions per minute of said two-stroke engine and comparing said revolutions per minute to a limit value; and, monitoring volumetric efficiency of said two-stroke engine and comparing said volumetric efficiency to a limit value; wherein said volumetric efficiency of said crankcase pressure ($p_{KGH}$) is determined at two predetermined crankshaft angles in advance of the opening of said transfer channel and after closing said transfer channel.

9. The method of claim 6, comprising the further steps of monitoring revolutions per minute of said two-stroke engine and comparing said revolutions per minute to a limit value.

10. The method of claim 6, comprising the further steps of monitoring volumetric efficiency of said two-stroke engine and comparing said volumetric efficiency to a limit value; wherein said volumetric efficiency of said crankcase pressure ($p_{KGH}$) is determined at two predetermined crankshaft angles in advance of the opening of said transfer channel and after closing said transfer channel.

* * * * *